US005953031A

United States Patent [19]

Omata et al.

[11] Patent Number: 5,953,031

[45] Date of Patent: Sep. 14, 1999

[54] INK TANK WITH INK CONTAINER AND WASTE INK CONTAINER

[75] Inventors: Kouichi Omata, Kawasaki; Yutaka Koizumi, Yokohama; Kiyomi Aono, Kawasaki; Tsutomu Abe, Isehara; Seiichiro Karita, Yokohama; Hiroki Tajima, Machida; Kazuo Haida, Yokohama, all of Japan

[73] Assignees: Canon Kabushiki Kaisha, Tokyo, Japan; Canon Aptex Inc., Ibaraki, Japan

[21] Appl. No.: 08/728,553

[22] Filed: Oct. 9, 1996

[30] Foreign Application Priority Data

Oct. 13, 1995 [JP] Japan ..... 7-266041

[51] Int. Cl.[6] ..... B41J 2/175

[52] U.S. Cl. ..... 347/86

[58] Field of Search ..... 347/85, 86, 87

[56] References Cited

FOREIGN PATENT DOCUMENTS 0604942 7/1994 European Pat. Off. .
0688673 12/1995 European Pat. Off. .
0710561 5/1996 European Pat. Off. .
0791463 8/1997 European Pat. Off. .
2-11334 1/1990 Japan .

OTHER PUBLICATIONS

"Waste Ink Collector With Overfill Indicator", 700 IBM Technical Disclosure Bulletin 29, (1987) Apr. No. 11, Armonk, NY, USA.

*Primary Examiner*—N. Le
*Assistant Examiner*—Michael Nghiem
*Attorney, Agent, or Firm*—Fitzpatrick, Cella, Harper & Scinto

[57] ABSTRACT

An ink leaking from an atmosphere communication hole of a waste ink container is guided to an end portion of the waste ink container. Electrodes are provided for shutting off an ink guide path. By this, the ink leaking through the atmosphere communication hole is inherently guided into the end portion of the container to come into contact with both of the electrodes. By contacting of the ink, a resistance value between the electrodes is varied to permit detection of ink leakage based on the variation of the resistance value. As a result, ink leakage from a waste ink container employed in an ink-jet printer or so forth can be certainly detected. Also, sealing ability of the waste ink container can be enhanced.

17 Claims, 12 Drawing Sheets

INK TANK WITH INK CONTAINER AND WASTE INK CONTAINER

BACKGROUND OF THE INVENTION

1. Field of the Invention

The present invention relates to an exchangeable type ink tank and an ink-jet printing apparatus employing the ink tank. More specifically, the invention relates to a cartridge type ink tank having an ink storage chamber and a waste ink storage chamber.

2. Description of the Related Art

As one example of a conventional ink tank, there has been known an ink cartridge in a form illustrated in FIGS. 1A and 1B. FIG. 1A is a sectional side elevation of the ink cartridge and FIG. 1B is a front elevation thereof.

As shown in the sectional side elevation, the ink cartridge includes an ink storage chamber 1 and a waste ink storage chamber 2. At respective positions on an end of the ink storage chamber 1, there are provided two rubber plugs 4 to be pierced by an ink supply needle provided on a main body of an ink-jet printing apparatus. Similarly, one rubber plug 4 is also provided at one position on an end of the waste storage chamber 2. These rubber plugs 4 are constructed to be clamped by a casing member 10A of the ink cartridge, an ink absorbing member 6 and a rubber plug retainer 7 except for portions to be pierced by the needles. With such construction, when the ink cartridge is removed from the main body of the printing apparatus, an ink adhering on the supply needle can be removed by the ink absorbing member 6 so as to prevent contamination of an inside of the printing apparatus by the ink adhering on the supply needle or plugging of the supply needle per se.

The waste ink storage chamber 2 is constructed with two layers of storage portions which are communicated with each other at one end of the chamber. A portion of the plug to be pierced by the ink supply needle is located corresponding to the storage portion of the lower layer. Through the rubber plug 4 of the waste ink storage chamber 2, the ink supply needle communicated with a discharge passage of the ink-jet printing apparatus pierces. By this a waste ink discharged during ejection recovery process or so forth flows into the lower layer of the storage portion of the waste ink storage chamber 2. Substantially entire space of the waste ink storage chamber 2 is filled with an absorbing member 8 so that the absorbing member 8 can absorb the waste ink flown into the lower layer of the storage portion. According to in-flow of the waste ink, a portion of the absorbing member 8 maintaining the waste ink is gradually spread to reach the absorbing body 8 in the upper layer storage portion, and a part of the waste ink absorbed exudes out of the absorbing body. On the other hand, a partitioning wall 2A is provided adjacent to the end of the absorbing member 8 in the upper storage portion of the waste ink storage chamber 2. By this, while the waste ink amount does not exceed a waste ink storage capacity of the absorbing member, an exuded ink may not flow over the partitioning wall 2A to enter into a space where the absorbing member 8 is not provided. When the accumulated waste ink amount in the waste ink storage chamber 2 exceeds the waste ink storage capacity, an amount of the exuded ink is one so that the waste ink also overflows the partitioning wall 2A to enter into the space at right side of the wall 2A. Then, a level of the waste ink in the right side space is elevated according to increasing of the waste ink flowing into the space, so that the waste ink in the right side space comes into contact with predetermined waste ink detecting electrodes 301*a* and 301*b*.

One end of each of the electrodes 301*a* and 301*b* (in FIG. 1A wherein only electrode 301*b* is illustrated) projects into the right side space defined by the partitioning wall 2A. On the other hand, the other end of each of these electrodes is arranged to be exposed to the end face of the ink cartridge (see FIG. 1B). Then, the electrodes exposed at the side of the end face may come into contact with a predetermined electrodes at the main body of the printing apparatus when the ink cartridge is loaded in the main body of the printing apparatus. With such construction, when the waste ink amount in the waste ink storage chamber 2 is increased so that two electrodes 301*a* and 301*b* conduct each other via the waste ink, the waste ink reaching the predetermined amount can be detected by the main body of the printing apparatus. As a result, measure, such as exchanging of the ink cartridge 1 or so forth can be taken by the printing apparatus.

Further, at an upper portion of a rear end portion of the waste ink storage chamber 2, an atmosphere communicating portion 9 is provided. Via this atmosphere communicating portion 9, an inside of the waste ink storage chamber 2 and atmosphere in an outside of the ink cartridge can be communicated with each other.

However, since the conventional ink tank is constructed by integrally forming the ink storage chamber 1 and the waste ink storage chamber 2, the following problems exist mainly in view of construction.

In the conventional ink cartridge, when the waste ink detecting electrodes are provided as set forth above, a step for forming a hole in the wall of the waste ink storage chamber for inserting the electrode becomes necessary. Also, since the hole is formed, sealing an around potion of the hole after installation of the electrode becomes necessary. By this, number of steps in production of the ink tank is increased. Furthermore, if the seal is incomplete, the waste ink may leak to degrade reliability of the waste ink storage chamber. Also, in formation of sealing, it is possible that a sealing member covers the electrodes to cause failure of the operation of the electrode.

Further, in the construction of the conventional waste ink detection as set forth above, in certain attitude in loading of the ink cartridge or in certain attitude of the printer, in which the ink cartridge is loaded, it is possible that the waste ink leaks through the atmosphere communicating portion 9 before the waste ink reaching the predetermined amount is detected by the waste ink detecting electrodes.

SUMMARY OF THE INVENTION

It is an object of the present invention is to provide an ink tank which can certainly detect overflow of a waste ink from an ink tank, can enhance sealing ability of an ink storage chamber or a waste ink storage chamber, can have high reliability and thus can be used conveniently, and an ink-jet printing apparatus employing such ink tank.

Another object of the present invention is to provide an ink tank which can detect leakage of an ink, particularly can detect ink leakage by introducing the leaking ink into a predetermined portion and by arranging detecting member, such as the electrode, within the predetermined portion, and an ink-jet printing apparatus employing the ink tank.

In a first aspect of the present invention, there is provided an ink tank for storing an ink comprising:

an ink detecting member provided on an outer portion of a container of the ink tank and adapted to contact with the ink leaking from the container to detect ink leakage.

In a second aspect of the present invention, there is provided an ink tank for storing an ink comprising;

a guide path forming member provided on an outer portion of a container of the ink tank and defining a guide path for guiding the ink flowing out from the container to a predetermined position of the. container; and an ink detecting member located at the predetermined position and for detecting the ink guided into the predetermined position.

In a third aspect of the present invention, there is provided an ink tank for storing an ink to be used in a printing apparatus and an ink used in the printing apparatus comprising:

an ink container storing the ink to be used in the printing apparatus;

a waste ink container for storing the ink used in the printing apparatus;

a coupling member provided one of or both of the ink container and the waste ink container for coupling the ink container and the waste ink container, and for defining a guide path for guiding the ink flowing out through an atmosphere communication hole of the waste ink container to a predetermined position of the ink container or the waste ink container; and a waste ink detecting member located at the predetermined position and for detecting the ink guided into the predetermined position.

In a fourth aspect of the present invention, there is provided an ink-jet printing apparatus for performing printing on a printing medium with using an ink-jet head, the ink-jet printing apparatus comprising:

an ink tank for storing an ink to be used in a printing apparatus and an ink used in the printing apparatus, the ink tank including:

an ink container storing the ink to be used in the printing apparatus;

a waste ink container for storing the ink used in the printing apparatus;

a coupling member provided one of or both of the ink container and the waste ink container for coupling the ink container and the waste ink container, and for defining a guide path for guiding the ink flowing out through an atmosphere communication hole of the waste ink container to a predetermined position of the ink container or the waste ink container; and a waste ink detecting member located at the predetermined position and for detecting the ink guided into the predetermined position; and a waste ink detecting means for detecting contact of the ink guided to the waste ink detecting member, with the waste ink detecting member while the ink tank is loaded on the ink-jet printing apparatus.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter in detail. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

First Embodiment

Figure 1B:
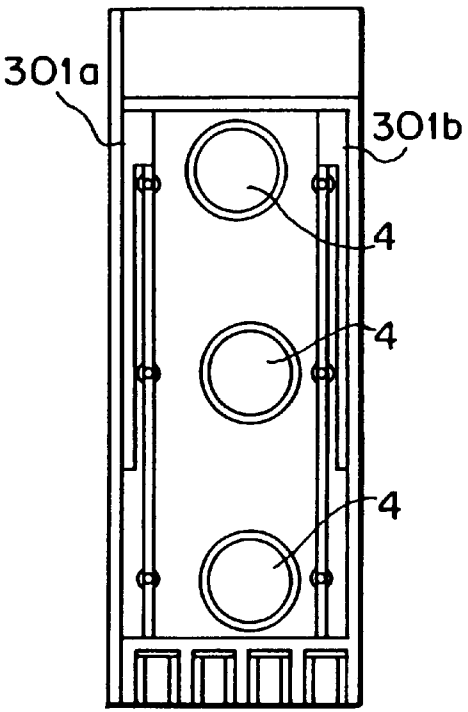
FIG. 1B PRIOR ART
FIGS. 1A and 1B are a side elevation and a front elevation of one example of the conventional ink tank, respectively.
Figure 1A:
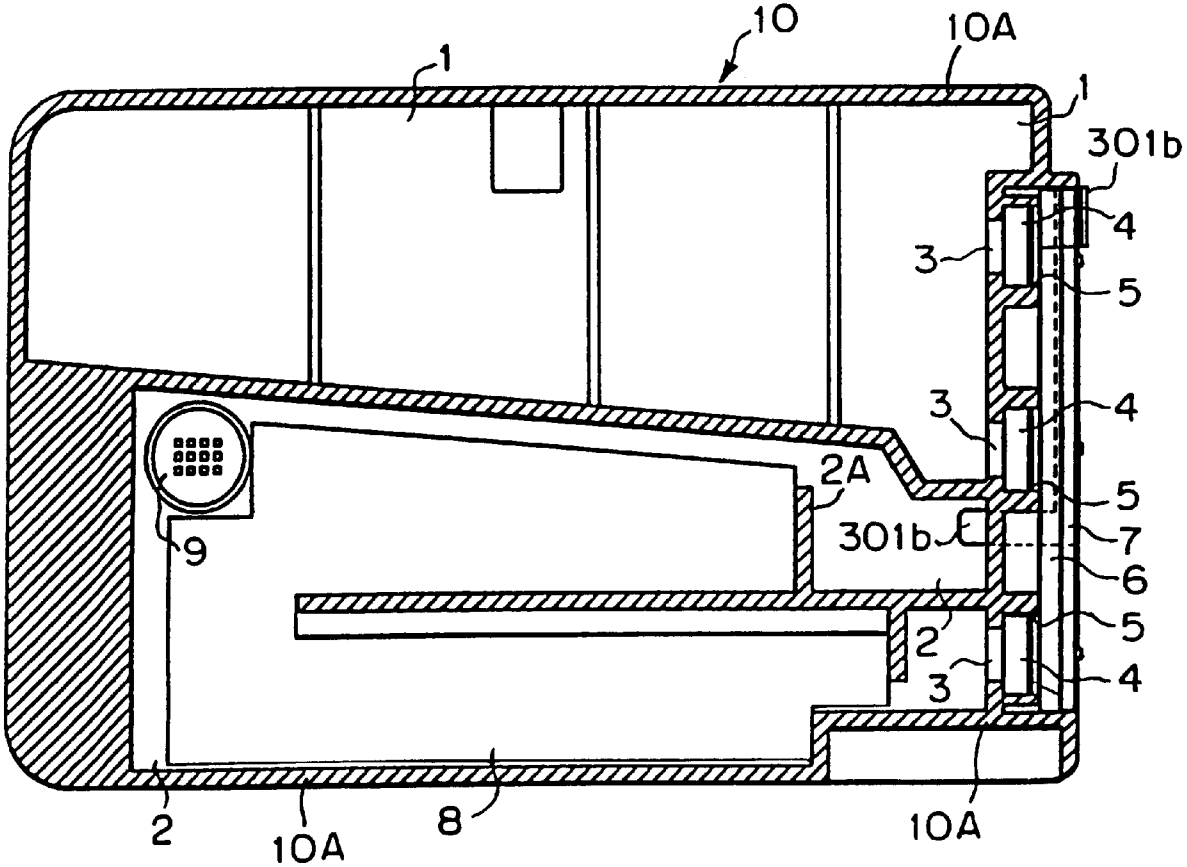
FIG. 1A PRIOR ART
Figure 2:
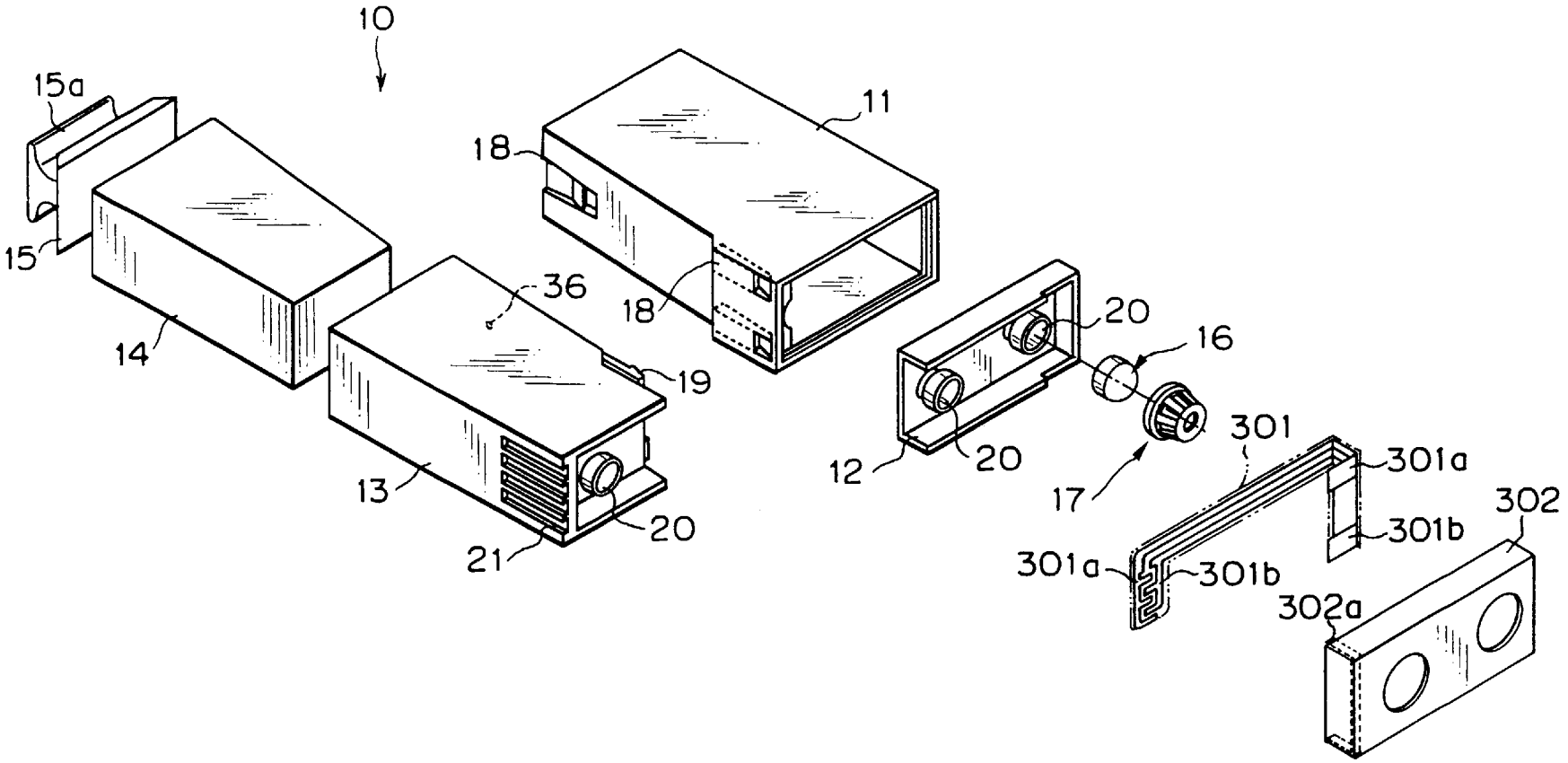
FIG. 2 is an exploded perspective view showing one embodiment of an ink cartridge according to the present invention.

FIG. 2 is an exploded perspective view showing an ink cartridge of one embodiment of the present invention. In the drawing, a reference numeral 11 denotes an ink container, a reference numeral 12 denotes a lid of the ink container 11. These components define an ink storage chamber 1. On the other hand, the reference numeral 13 denotes a waste ink container, and an absorbing member 14 is housed within the waste ink container 13. The absorbing member 14 is adapted to absorb and hold an ink collected within the waste ink container 13. To the waste ink container 13 housing the absorbing member 14, a waste ink lid 15 is mounted. By this, a waste ink storage chamber is defined. The lid 12 is attached to the ink container 11 by way of ultrasonic welding. Similarly, the waste ink lid 15 is attached to the waste ink container 13 by way of ultrasonic welding.

At respective one end portions of the lid 12 of the ink container 11 and the waste ink container 13, a housing 20 forming communication holes is provided. Dome shaped elastic members 16 are assembled to respective of the communication holes. Also, crown members 17 are also assembled over the dome shaped elastic bodies 16, respectively. Thus, coupling portions for ink communication with an ink-jet printing apparatus are formed. The ink container 11 and the waste ink container 13 are integrated by engaging an engaging portion 18 with an engaging claw 19 to form an ink cartridge. At an inside of the lid 12 of the ink container 11, a casing 302 is assembled. On the casing 302, one end of each of two electrodes 301*a* and 301*b* is attached to a surface side of the casing 302 and another end of each of electrodes 301*a* and 301*b* is attached to the back side of the casing 302. Also, at one end portion in the longitudinal direction of the casing 302, an ink absorbing member 302*a* is bonded. It should be noted that instead of employing the absorbing member, it is possible to provide a member which is constituted of a plurality of fins and can maintain an ink by capillary force, or a sealing member of an elastic member for merely preventing an ink from leaking out of the casing 302 may be provided at the same position. Alternatively, without providing such members within the casing, an ink receptacle portion may be provided at the lower portion of the waste ink container.

Figure 3:
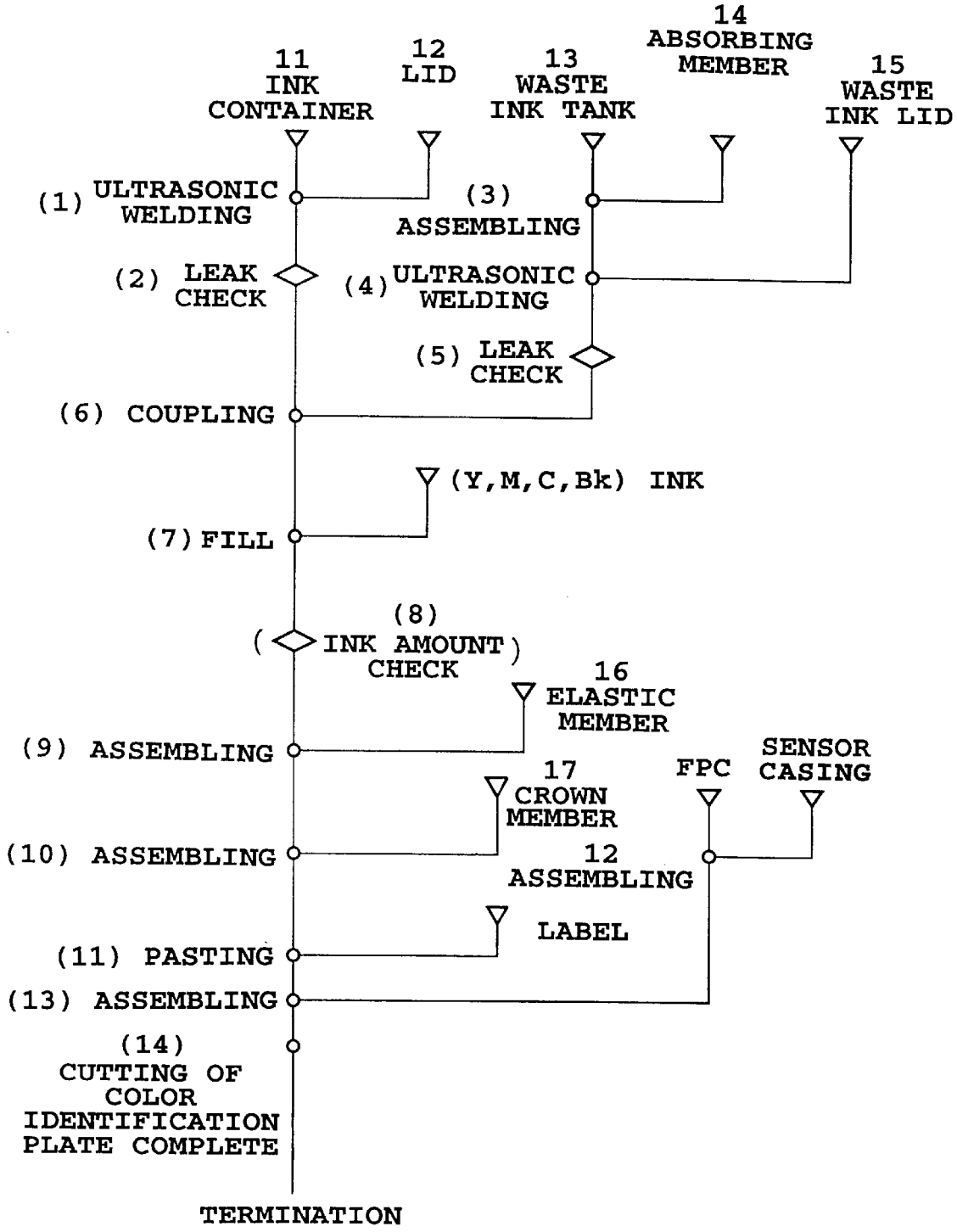
FIG. 3 is a flowchart showing a process for assembling the ink cartridge of the embodiment.

Next, according to a flowchart showing a production process of the ink cartridge, shown in FIG. 3, production process of the shown embodiment of an ink tank will be discussed.

The ink container 11, the lid 12, the waste ink container 13, the waste ink lid 15 and the crown member 17 are provided as respective parts preliminarily formed by injection molding. In the shown embodiment, the elastic member 16 is formed of a rubber member, which is a moulded rubber or one moulded by injection or so forth. Furthermore, as the absorbing member 14, a part formed by simply pressing an absorptive material, such as laminated paper or so forth can be employed. It should be noted that as the material for the elastic member 16, an elastomer may also be employed.

As the production process, at first, (1) the ink container 11 and the lid 12 are assembled by way of ultrasonic welding. At this process, since the ink container 11 and the lid 12 are components, in which the ink is directly filled, it is desirable to perform assembling after cleaning as required. (2) Next, for verifying condition of a welded portion as assembled, a leak check is performed. This leak check is performed with employing one of two housings 20 (see FIG. 2) as pressure detecting hole arid by pressurizing the interior space of the ink container through another of the two housings and by checking whether the pressure is maintained constant for a given period, or not. However, when welding per se is stably performed, the leak check may be performed not for all but for several samples, or may be not performed.

(3) Next, the absorbing member 14 is housed within the waste ink container 13, and then (4) the waste ink lid 15 is assembled to the waste ink container 13 by way of ultrasonic welding. (5) Also in this case, the leak check of the welded portion may be performed as required. It should be noted that, in this case, pressurization of the interior space can be performed via atmosphere communication hole 36 (see FIG. 2).

(6) The ink container and the waste ink container which are verified that no leakage is caused, are coupled. Coupling of the ink container 11 and the waste ink container 13 is performed by engaging the engaging portion 18 provided on the ink container 11 with the engaging claw 19 provided on the waste ink container 13 in a manner described later.

(7) Next, the ink container 11 is set in an ink filler machine at an orientation where the housing 20 of the ink container 11 is directed upwardly. Then, with taking one of the housings 20 of the lid 12 as filler opening and the other housing 20 as discharge opening for an air of an inside of the ink container 11, necessary amount of the ink is filled. (8) Thereafter, weight check or so forth performed as verification of filled ink amount is performed as required.

When filing of the ink is completed, (9) the elastic members 16 are respectively mounted on the housings 20 of the ink container and the waste ink container. (10) Then, the crown members 17 are fitted over the elastic bodies 16, respectively to complete assembling of the coupling portions. Subsequently, (11) a label (not shown) is pasted on a potion of the side surfaces of the ink container and the waste ink container, which portion is discussed later. Furthermore, (12) a flexible printing circuit board 301 (hereinafter referred to as FPC, and shown by broken line in FIG. 2) formed with electrodes 301*a* and 301*b* for detecting leakage of the waste ink is attached to the casing 302. (13) An ink absorbing member 302*a* is preliminarily pasted on the casing 302, and this casing 302 is assembled to the lid 12 of the ink container 11. Also, (14) upon loading of the ink cartridge to the printing apparatus, in order to prevent erroneous loading of the cartridge, an ink color identification plate 21 is cut into a pattern depending upon a color of the ink to be contained.

Through the foregoing processes, production of the ink cartridge can be completed. It should be noted that, the foregoing processes is one example, and the order of the production process is not essential.

Figure 4:
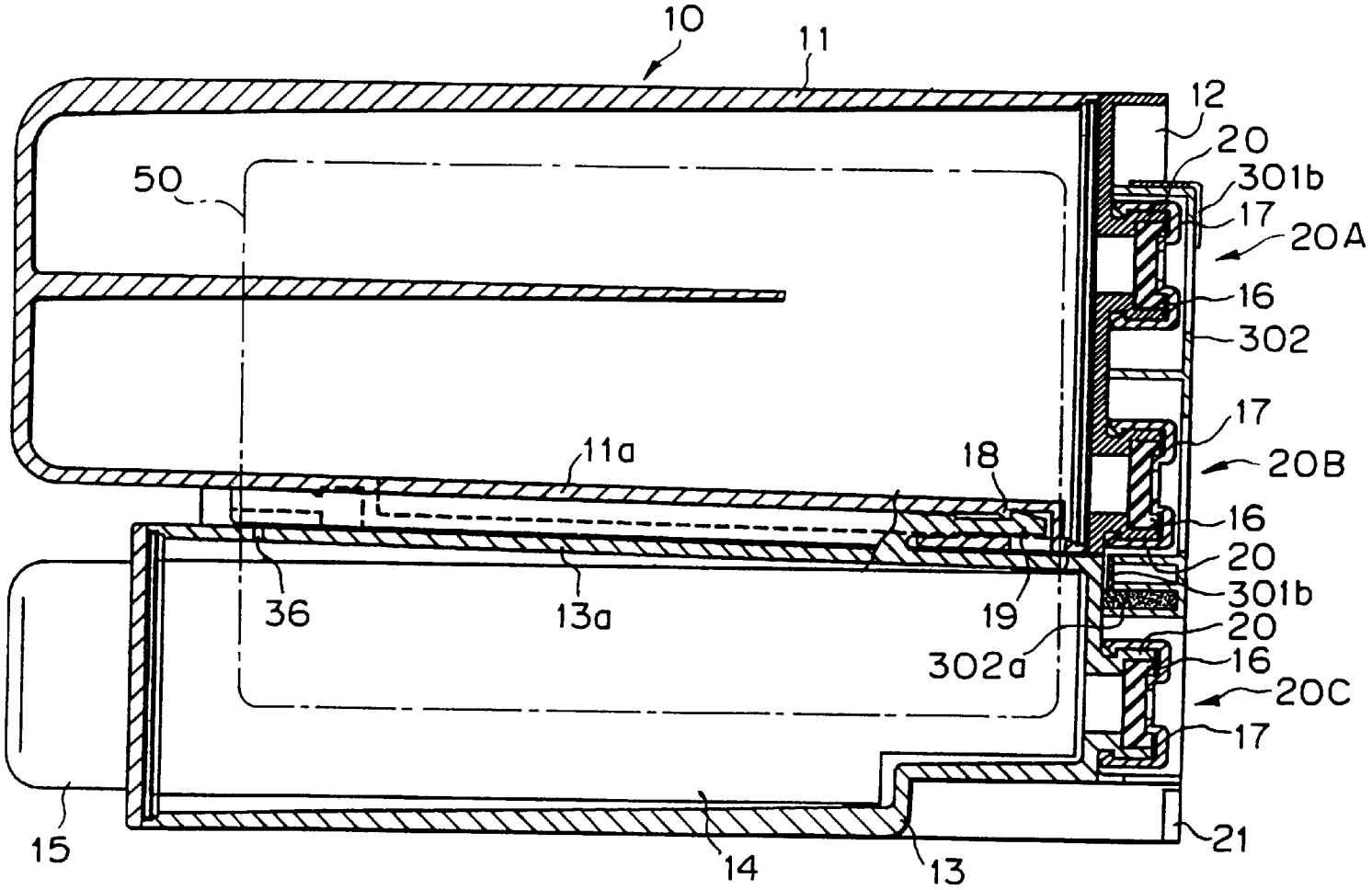
FIG. 4 is a section showing the ink cartridge of the embodiment.
Figure 5:
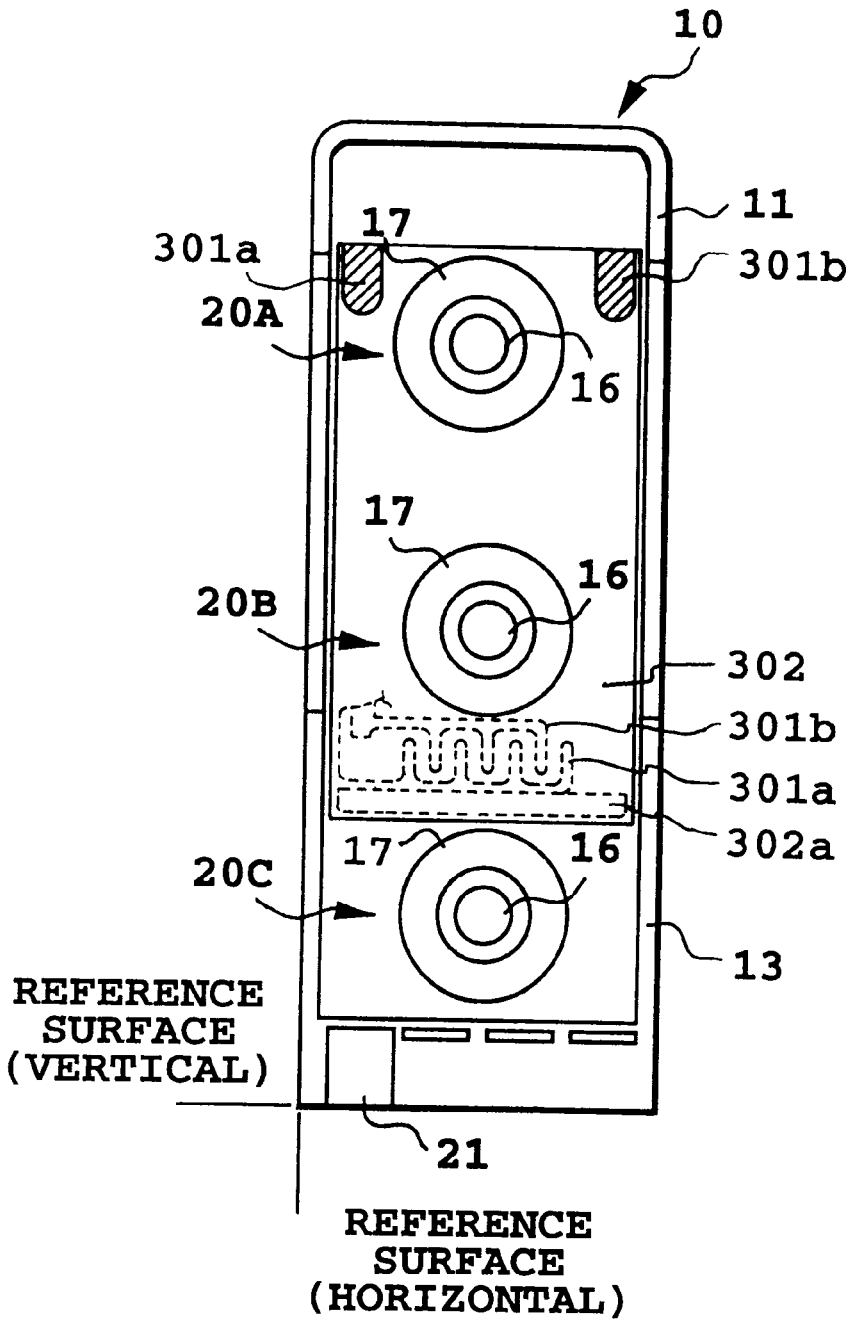
FIG. 5 is a front elevation of the ink cartridge of the embodiment as viewed from a coupling portion coupled with a main body of an ink-jet printing apparatus.

FIG. 4 is a section of the ink cartridge completed through the foregoing process, and FIG. 5 is a front elevation as viewed from the coupling portion to be coupled with the main body of the printing apparatus.

As can be clear from a discussion for the production process, a process for assembling the ink container 11 and the lid 12, and a process for housing the absorbing body 14 in the waste ink container 13 and for assembling the waste ink container and the waste ink lid 15 are performed as completely separated processes. Therefore, the interior space of the ink container 11 may not be contaminated by refuse of the absorbing member 14.

Further, since verification whether the welding of the ink container and the waste ink container is certainly completed or not, can be performed independently, inspection can be facilitated. Even when failure of welding is caused, identification of the portion where welding failure is caused, is facilitated, and that troubleshooting and measure therefor can be done easily. By this, even when nonconformity is caused in the assembling condition or so forth, failure will never be continued for a long period. Also, even if failure is caused, measure has to be taken only for faulty one of the ink container and the waste ink container, the ink tank with improved yield and high reliability can be provided. Furthermore, as can be clear from the drawing, welding area can be made much smaller in comparison with that in the prior art. Therefore, even for unstable factor, such as deflection of the parts, dimensional fluctuation and so forth, welding can be performed stably. Also, large size welding apparatus becomes unnecessary. Conversely, with utilizing this effect, the ink cartridge with greater capacity than that of the conventional one can be produced.

Furthermore, because of small welding area described above, a material, such as polypropylene (P.P.), polybutylene-telephthanol (P.B.T.) or the like, which has high gas barrier capacity to be ideal as a material for the ink tank container but is difficult to use for poor welding ability, can be certainly welded. Particularly, since P.P. material is low in material cost and has high transparency, the tank container formed of the PP material permits the user to visually check an ink remaining amount for convenience of use.

Next, in FIG. 4, a bottom surface 11*a* of the ink container 11 is constructed to lower at the coupling portion side in the condition coupled with the waste ink container 13. By this, when the remaining ink amount is small, the ink can be concentrated at the coupling portion side 20B. It should be noted that an inclination of the bottom surface may be formed by utilizing a draft angle upon formation of the injection molding of the ink container 11.

The atmosphere communication hole 36 provided in the waste ink container 13 maintains the pressure in the waste ink container 13 at atmospheric pressure. By this, inflow of the waste ink from the main body of the printing apparatus via the coupling portion 20C can be performed smoothly. The atmosphere communication hole 36 is provided at positioned distanced from the coupling portion 20C of the waste ink container 13. More specifically, the atmosphere communication hole 36 is located at relatively high position in the waste ink container 13 so that the collected waste ink may not leak out until the inside of the waste ink container is filled with the waste ink.

Figure 9:
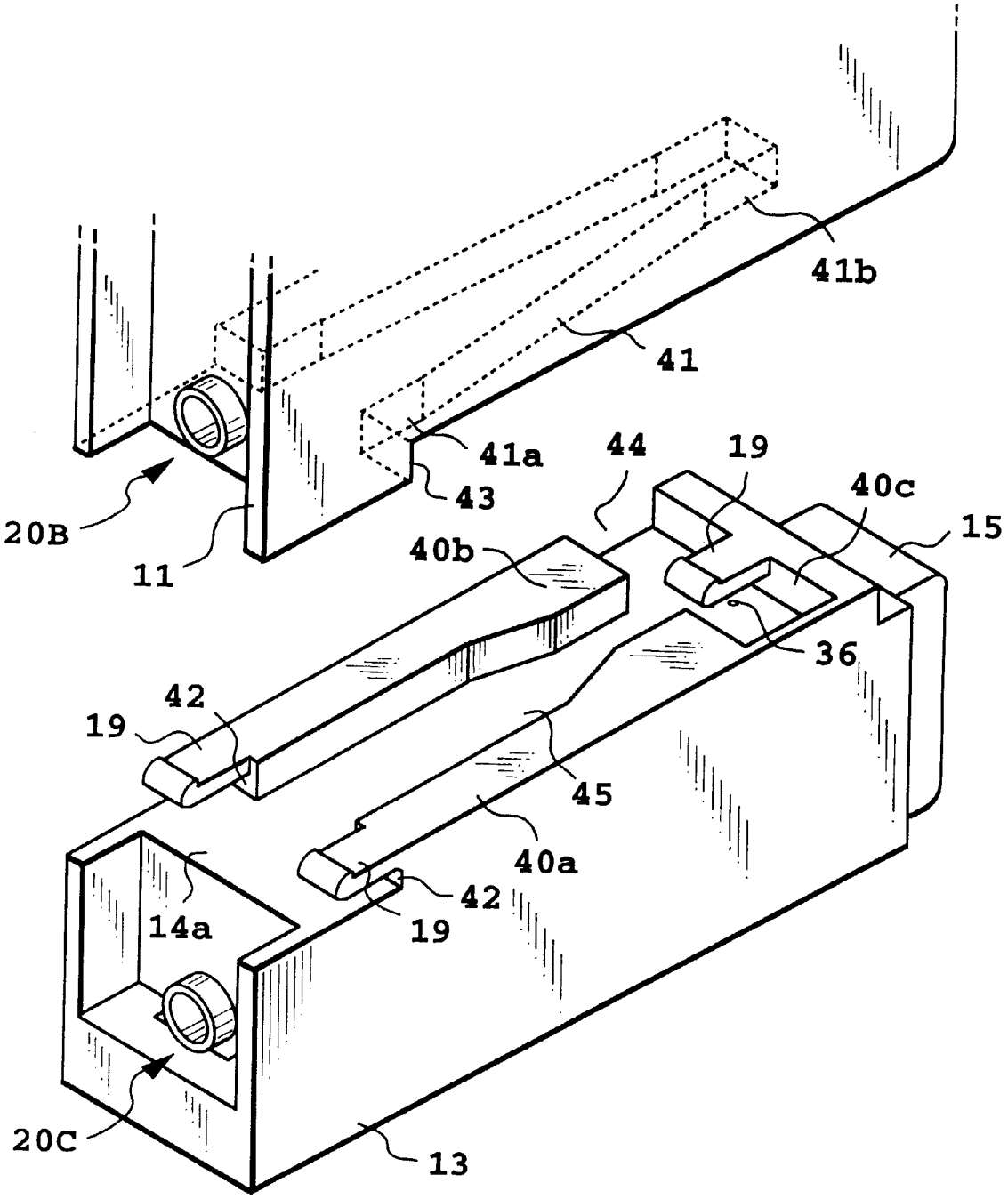
FIG. 9 is a perspective view showing an engaging portion of a waste ink container forming the ink cartridge of the embodiment as coupled with an ink container.

Furthermore, in the worst case where the collected waste ink overflows, the ink flows frontwardly, namely toward the coupling portion 20C and will never reach a handle of the waste ink lid 15 which will be touched by the user's hand. This is because the wall 13*a* of the ceiling of the waste ink container is located at lower elevation at the coupling portion 20C side, and a members for coupling and positioning waste ink container 13 with respect to the ink container 11 are provided on the upper surface of the waste ink container 13 to serve as guides for the overflown waste ink, as shown in FIG. 9. More specifically, as shown in FIG. 9, on an upper surface of the waste ink container 13, guide members 40*a* and 40*b* for guiding engaging claws 19 thereof during engaging operation where the engaging claws 19 engages with the engaging portions 18 of the ink container 11. Further, at the handle portion side end, a wall member 40C projecting the engaging claws 19 is provided. By this, a waste ink passage extending from the atmosphere communication hole 36 to reach the front end portion of the waste ink container 13, namely to the coupling portion side.

Furthermore, in FIG. 9, the reference numeral 44 denotes a cut out portion required in relation to a mold upon formation of the engaging claws at the rear end side of the waste ink container. Therefore, in certain mold for injection molding, the cut-out portion 44 may become unnecessary. Also, the cut-out portion 44 may be closed by pasting the label in the region identified by one-dotted line in FIG. 4. By this, the passage for the waste ink can be made as enclosed space. Also, leakage of the ink through the cut-out portion 44 can be successfully prevented.

The inclination of the ceiling of the waste ink container 13 may also be formed utilizing the drafting angle similarly to the bottom surface 11*a* of the ink container 11.

Figure 10:
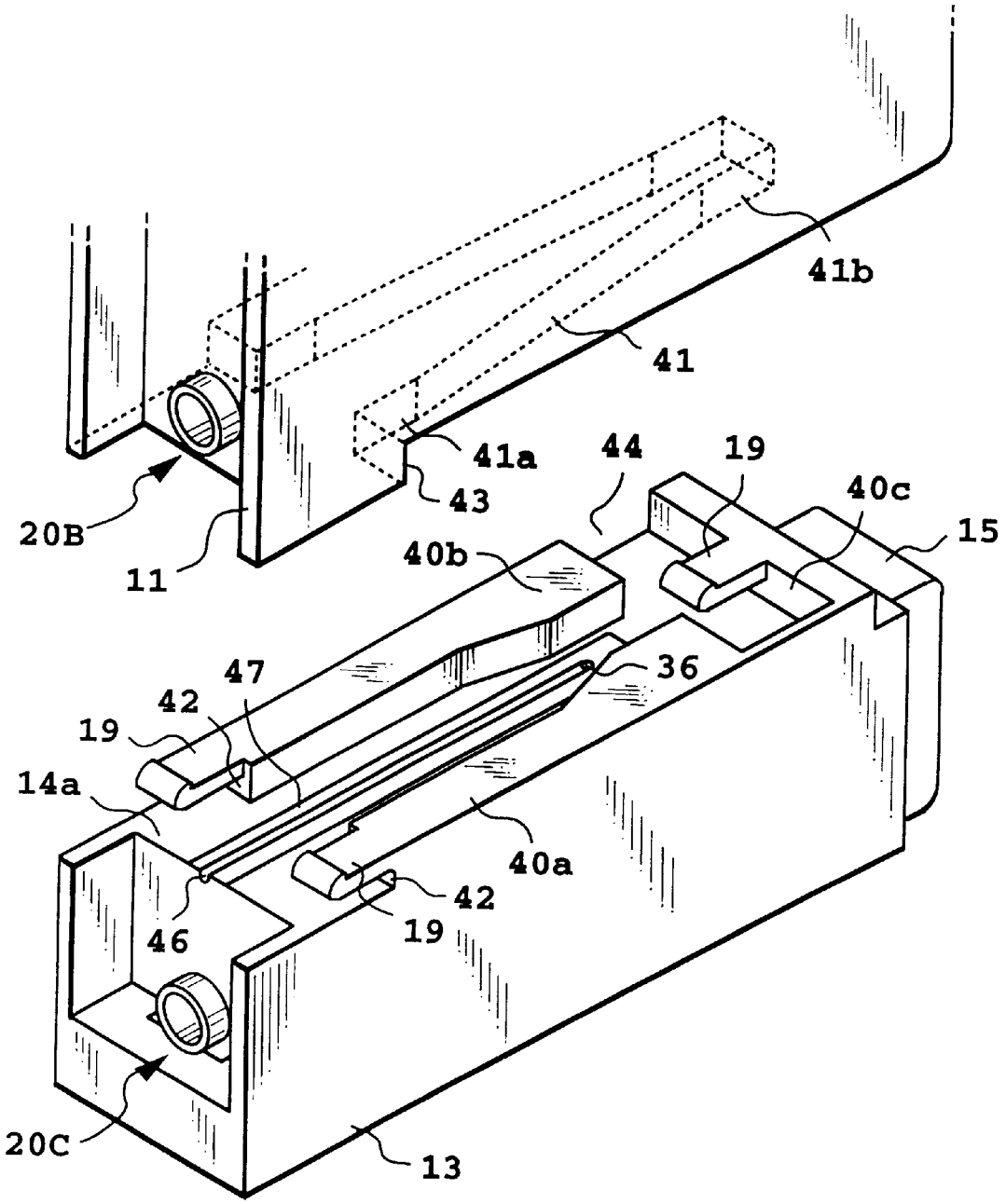
FIG. 10 is a perspective view showing another embodiment of the engaging portion.

With respect to the construction of the waste ink passage as set forth above, when inflow pressure of the waste ink flowing into the waste ink container 13 upon collection of the waste ink is relatively high due to specification of the printing apparatus or so forth, the waste ink may spilled out through the atmosphere communication hole 36 to cause unnecessary ink leakage. In case of the ink cartridge to be used for such main body of the printing apparatus, a construction shown in FIG. 10 is desirable.

More specifically, the atmosphere communication hole 36 is provided at a position inclined toward the coupling portion 20C side in comparison with the case of FIG. 9, and an ink guide groove 46 extending from the atmosphere communication hole 36 to the coupling portion 20 is formed. A lid member 47 is bonded on an upper surface of the guide groove 46. As the lid member 47, a tape like member may be employed. It should be noted that, in FIGS. 9 and 10, the electrodes and the casing for mounting the former are neglected from illustration.

As set forth above, by forming the waste ink guide groove from the atmosphere communication hole 36 to the coupling portion side, the waste ink may be certainly guided toward the coupling portion side irrespective of a type of the waste ink correcting system.

The ink guided to the coupling portion side faces end of the guide passage formed on the upper surface of the waste ink container 13 to contact with the electrodes 301*a* and 301*b* arranged to shut off the guide passage.

With such construction, when the waste ink leaks through the atmosphere communication hole, the ink is certainly guided to the detecting electrode. Therefore, leakage of the waste ink can be certainly detected. This means that flowing out of the waste ink not only when the waste ink container is fully filled with waste ink to cause overflow but also when flowing out is caused by variation of the environmental pressure or variation of attitude of the waste ink container even before the waste ink container is fully filled with the waste ink. Namely, with the arrangement set forth above, flowing out of the waste ink at any condition can be certainly detected. Also, since the shown construction does not require to form a hole or so forth for installation of the electrode for the waste ink sensor, the ink cartridge having high seal ability in the waste ink container and high reliability can be provided.

It should be noted that the ink contacting with the electrode is subsequently absorbed and held by the absorbing member 302*a* located immediately below the electrode, the interior of the printing apparatus will never be contaminated by the ink.

Figure 6:
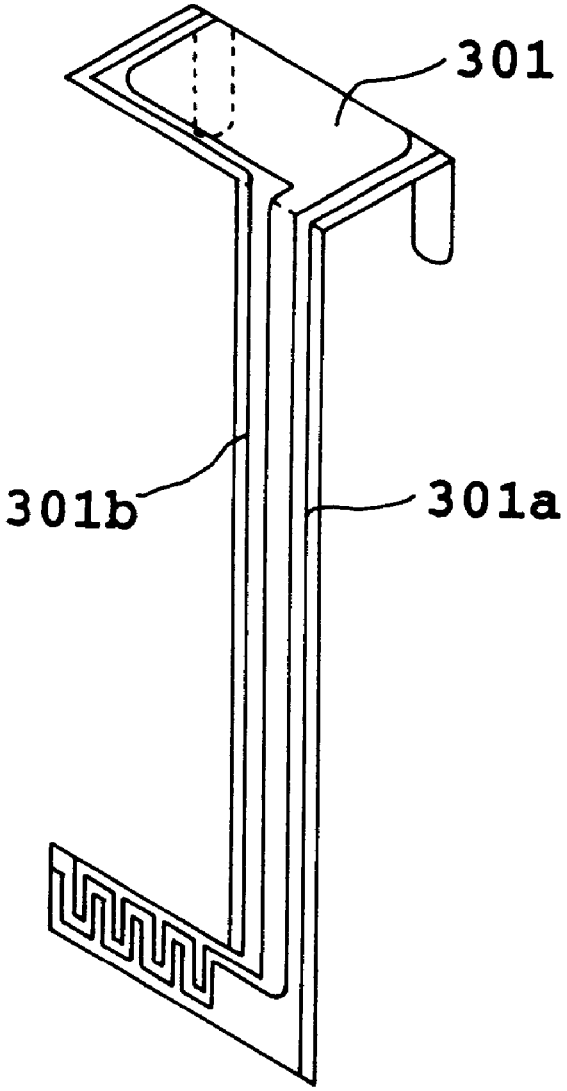
FIG. 6 is a perspective view of an electrode for a waste ink leakage sensor to be employed in the ink cartridge of the embodiment.

FIG. 6 is an illustration of the electrodes 301*a* and 301*b* for the waste ink sensor as viewed from a waste ink container side.

The electrodes 301*a* and 301*b* are formed on FPC and forms a pattern as shown by black portion in FIG. 6. As set forth above, one ends of respective of the electrodes 301*a* and 301*b* are lead out to an end face of the coupling portion of the container along the casing. The electrode lead to the end face of the container may contact with the electrode on the printing apparatus when the ink cartridge is loaded on the main body of the printing apparatus. By this, if waste ink leaks and contacts with the electrodes 301*a* and 301*b*, resistance between the electrodes is varied due to presence of the waste ink between the electrodes. Therefore, by detecting this, leakage of the waste ink can be detected.

Figure 7:
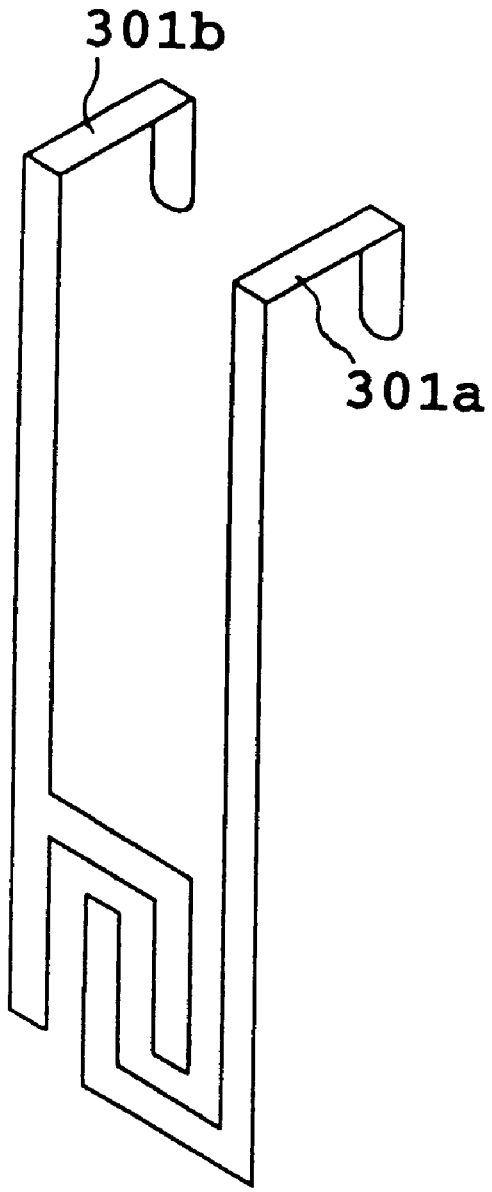
FIG. 7 is a perspective view showing another embodiment of the electrode for the waste ink leakage sensor.

FIG. 7 shows another embodiment of the electrode for the waste ink sensor.

The electrodes shown in FIG. 7 are formed through press process of a thin metal plate. Similarly to the former embodiment employing FPC, two electrodes are opposed to each other across a small gap at a position facing with a portion where the waste ink is introduced. When the waste ink contacts with these electrodes, leakage of the waste ink can be detected. Since the shown embodiment may lower the production cost of the electrodes in comparison with those formed with FPC, the overall cost of the ink tank can be lowered.

Figure 8:
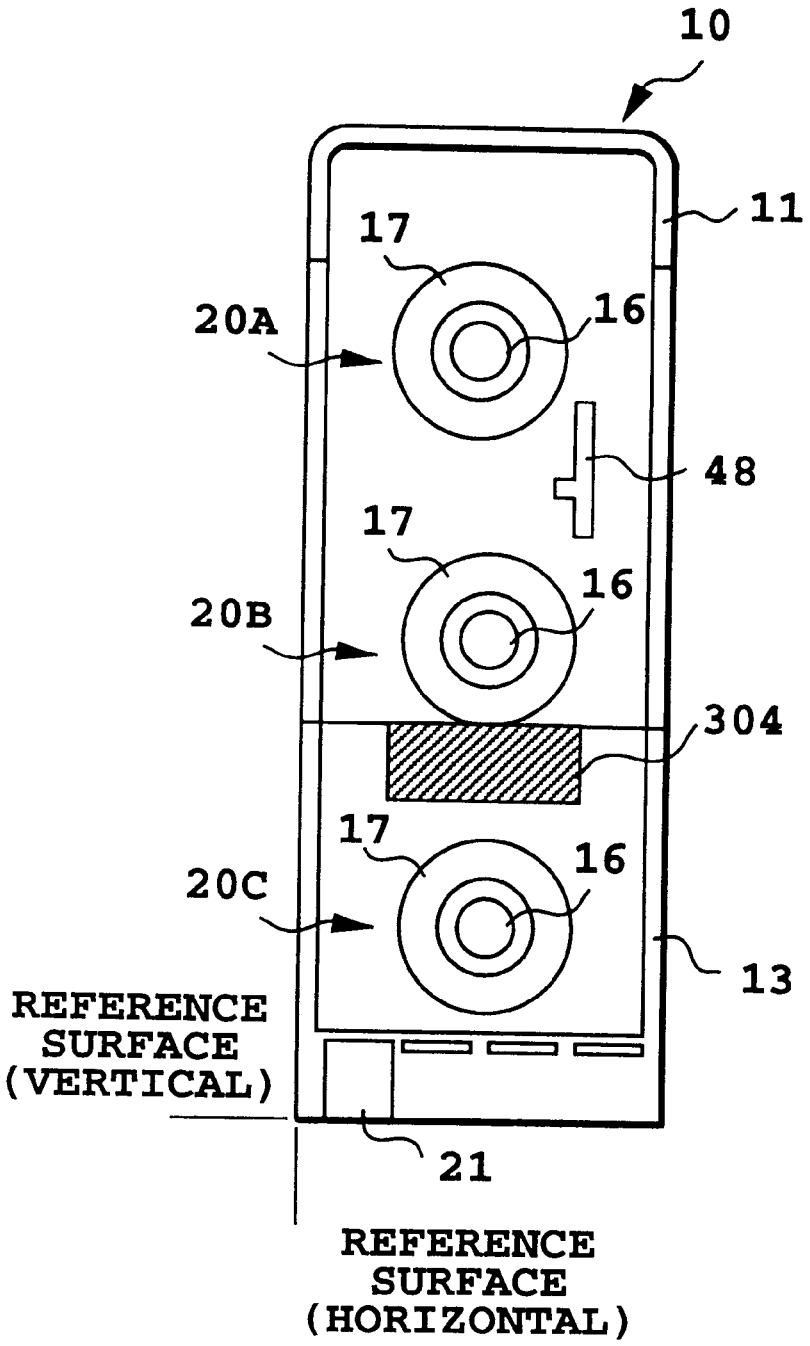
FIG. 8 is a perspective view of another embodiment of the electrode for the waste ink leakage sensor.

FIG. 8 shows another embodiment of the waste ink sensor.

A sensor shown in FIG. 8 is differentiated from the sensor employing the electrode as set forth above in that a porous absorbing member 304 for absorbing the ink is provided. When the waste ink leaks out, the absorbing member absorbs the ink to cause variation of the color. On the other hand, the main body of the printing apparatus may be provided with an optical sensor to read variation of the color of the absorbing member to detect leakage of the waste ink.

With the construction set forth above, since no electrical contact is provided between the main body of the printing apparatus and the ink tank, erroneous detection due to contact failure can be successfully avoided to enhance reliability in detection of flowing out of the waste ink.

It should be noted that while the foregoing embodiments are directed to the constructions for detecting leakage of the ink from the waste ink container, it should be obvious to those skilled in the art to employ similar construction in the normal ink container having no waste ink container.

Figure 11:
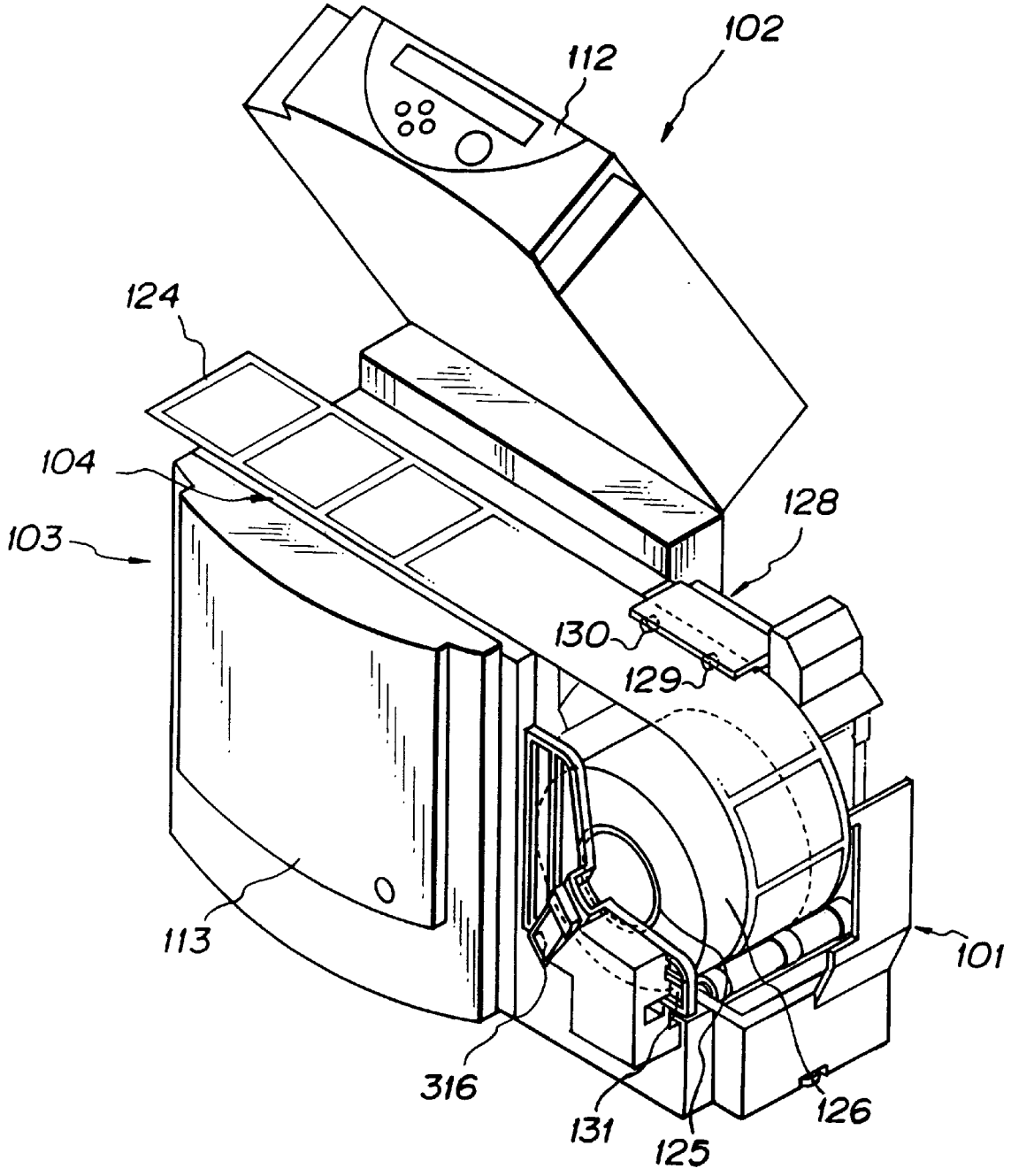
FIG. 11 is a perspective view showing the embodiment of an ink-jet printing apparatus according to the present invention.
Figure 12:
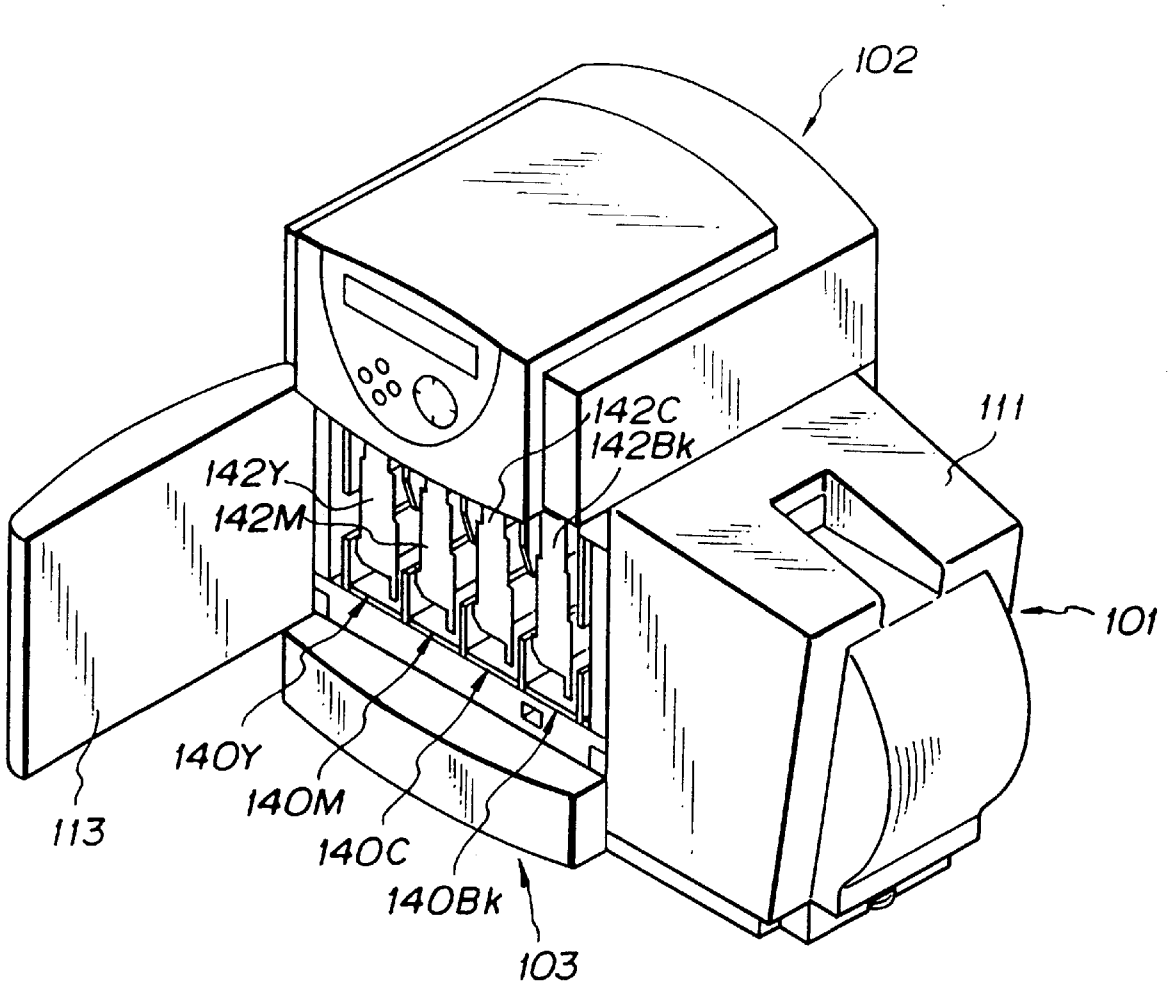
FIG. 12 is an illustration for explaining loading and unloading of the ink cartridge in the printing apparatus.

FIG. 11 shows a label printer as an example of the ink-jet printing apparatus, for which the ink cartridge as set forth above can be employed removably, and is a perspective view showing a condition where a cover 111 (see FIG. 12) of a roll paper feeder unit 101 is removed, and a printing head portion 102 is pivoted upwardly. On the other hand, FIG. 12 is a perspective view in a condition where a front cover 113 of an ink cartridge receptacle portion 103.

As shown in FIG. 11, a roll 126, on which a roll paper 124 is wound and which is stored in the roll paper feeder unit 101 is mounted on two driving rollers 301 (one is not shown) provided at the bottom of the unit 101. An outer periphery side of the roll 126 and the driving rollers 301 are contacted under pressure by the own weight of the roll paper. At this condition, the driving rollers 301 are driven to rotate by a not shown motor to separate the outer most roll paper from the inner side roll paper to feed. Feeding of the roll paper 124 is performed substantially irrespective of transportation by a roll paper transporting mechanism (104) (detail is not illustrate). Therefore, in order to adjust transportation between these two portions, in the foregoing roll paper feeder, feeding of the roll paper is controlled to form a slack to be a buffer. Namely, when a loop sensor (not shown) does not detect the loop by transportation in the transporting mechanism, the driving roller is driven to perform feeding of the roll paper with forming the loop.

A paper guide 131 is provided for sliding in a width direction of the roll 126. Namely, upon receiving the roll paper, the paper guide 131 is slid in a width greater than the width of the roll paper 124 to facilitate placing of the roll 126 on the driving roller. Then, the paper guide 131 is slid to the width of the roll 126 to abut a part thereof onto a core member 125 of the roll 126. By this, upon feeding of the roll paper 124, deflection of the roll paper 124 in width direction at upstream side of the driving roller in the feeding direction is restricted with permitting a given fine deflection. It should be noted that the paper guide 131 is provided with a stopper 316 for fixing the slide position thereof.

In the roll paper transporting path, an oblique feeding unit 128 is provided in the vicinity of the inlet of the feeding path by the transporting mechanism 104. The oblique feeding unit 128 has two oblique feeding rollers (not shown) contacting on the lower surface of the roll paper 124 and oblique feeding rolls 129 and 130 opposing to the oblique feeding rollers and contacting on the upper surface of the roll paper 124. Two oblique feeing rollers are constituted with a driving roller opposing to the oblique feeding roll 130 and being provided a driving force from the transporting mechanism 104 side to be driven, and a driven roller opposing to the oblique feeding roll 129 and being not provided the driving force. Respective oblique feeding rollers are adapted to rotate obliquely with respect to the feeding direction of the roll paper (rotation axes are mounted with respect to the transporting direction and with respect to the direction perpendicular to the transporting direction). On the other hand, oblique feeding rolls 129 and 130 are also mounted in oblique with respect to the transporting direction similarly to the oblique feeding rollers. By these oblique feeding rollers and oblique feeding rolls 129 and 130, transporting force is provided to the transported roll paper in oblique direction for urging the roll paper toward a predetermined guide at the back side in the drawing. As a result, since the roll paper 124 is applied a restricting force in a given direction, stable transportation without deflection of the transporting direction or so forth can be performed.

The roll paper transporting mechanism 104 provided between the printing head portion 102 and the ink cartridge receptacle portion 103 is constructed with a plurality of belts which are neglected from illustration in FIG. 11 but is located at lower side of the roll paper 124 in the drawing (accordingly, arranged on the upper surface of the ink cartridge receptacle portion 103) and extend in transporting direction, rollers provided at upstream side and downstream side in the for driving the belts, and a spur wheel arranged lower surface of the printing head portion 102 and provided the driving force via a predetermined belt among a plurality of belts. Heads of the printing head portion 102 ejecting respective of yellow (Y), magenta (M), cyan (C) and black (Bk) inks are designed to generate bubble in the ink utilizing head energy generated by an electrothermal transducer and to eject the ink by the pressure of the bubble.

In FIG. 12, the ink cartridge receptacle portion 103 has four cartridge receptacle chambers 140Y, 140M, 140C and 140Bk corresponding to four kinds of inks of yellow (Y), magenta (M), cyan (C) and black (Bk). In the vicinity of inlet of each cartridge receptacle chamber, shutters 142Y, 142M, 142C and 142Bk for substantially shielding the insides of respective receptacle chambers are provided. These shutters are pivotably supported at the upper portions and designed for preventing user from inserting hand within the receptacle chamber to touch ink supply needles. Upon insertion of the ink cartridge, the shutter is depressed toward back side of the receptacle chamber by the ink cartridge per se to open to permit insertion.

As can be clear from the discussion given hereabove, with the shown embodiments of the present invention, when leakage of the ink is caused, the occurrence of leakage is certainly detected. Especially, leaked ink is guided into the predetermined position, and the detecting member, such as the electrodes are arranged at the predetermined position. Therefore, the leakage of the ink can be certainly detected. As a result, the ink leakage can be certainly detected irrespective of the ink tank condition. Also, sealing ability of the ink storage chamber and the waste ink storage chamber can be enhanced to provide the ink tank with high reliability to be used conveniently and the ink-jet printing apparatus employing the ink tank.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An ink tank for storing an ink to be used for printing and a waste ink not used for printing the ink tank adapted to be exchangeably loaded on a printing apparatus, the ink tank comprising:

an ink container unit for storing the ink to be used for printing, the ink container unit having an ink supply communicating portion for supplying the ink to be used for printing to outside the ink tank;

a waste ink container unit for storing the waste ink, the waste ink container unit having an ink receive communicating portion for receiving the waste ink;

a connecting member provided on said ink container and/or said waste ink container unit for connecting said ink container unit and said waste ink container unit to each other;

a communicating path communicating with an outer surface of said ink tank, said communicating path being formed upon connecting said ink container unit and said waste ink container unit to each other; and an ink detecting member provided on said outer surface, wherein ink flows out of said waste ink container unit through a communicating opening which communicates with an inside of said waste ink container unit, and is guided to said ink detecting member along said communicating path.

2. An ink tank as claimed in claim 1, wherein said ink detecting member has a plurality of electrodes with which the waste ink flowed out of said waste ink container unit comes into contact, and detects said flowed ink on a basis of variation of an electrical condition.

3. An ink tank as claimed in claim 1 wherein said ink detecting member has an absorbing member and detects the waste ink flowed out of said waste ink container unit by optically reading color variation of said absorbing member caused by absorption of the flowed ink.

4. An ink tank as claimed in claim 1, which includes a label pasted over both of said ink container unit and said waste ink container unit for defining said communicating path.

5. An ink tank as claimed in claim 1, wherein said connecting member includes an engaging recessed portion, an engaging snap portion engaging with said recessed portion by elastic deformation and a spring portion biasing said engaging snap portion in a direction for fixing engagement with said recessed portion.

6. An ink tank as claimed in claim 5, wherein an engaging claw engaging with respective tip ends of said engaging recessed portion and said spring portion are provided in said snap portion.

7. An ink tank as claimed in claim 1, wherein said ink container unit is filled with the ink.

8. An ink tank as claimed in claim 1, wherein said ink detecting member is disposed on a side outer surface of said ink tank on which surface said ink supply communicating portion and said ink receive communicating portion are positioned, and said communicating path has descent towards said side outer surface.

9. An ink-jet printing apparatus for performing printing on a printing medium using an ink-jet head, said ink-jet apparatus comprising:

an ink tank for storing an ink to be used for printing and a waste ink not used for printing, said ink tank adapted to be exchangeably loaded on a printing apparatus, said ink tank including:

an ink container unit for storing the ink to be used for printing, the ink container unit having an ink supply communicating portion for supplying the ink to be used for printing to outside the apparatus;

a waste ink container unit for storing the waste ink, the waste ink container unit having an ink receive communicating portion for receiving the waste ink a connecting member provided on said ink container unit and/or said waste ink container unit for connecting said ink container unit and said waste container unit to each other;

a communicating path communicating with an outer surface of said ink tank, said communicating path being formed upon connecting said ink container unit and said waste ink container unit to each other; and an ink detecting member provided on said outer surface, wherein waste ink flows out of said waste ink container unit through a communicating opening which communicates with an inside of said waste ink container unit, and is guided to said ink detecting member along said communicating path; and a waste ink detecting means for detecting contact of said ink guided to said ink detecting member with said ink detecting member while said ink tank is loaded on the ink-jet printing apparatus.

10. An ink-jet printing apparatus as claimed in claim 9, wherein said ink detecting member has a plurality of electrodes with which the waste ink flowed out of said waste ink container unit comes into contact, and detects said flowed ink on a basis of variation of an electrical condition.

11. An ink-jet printing apparatus as claimed in claim 9, wherein said ink detecting member has an absorbing member and detects the waste ink flowed out of said waste ink container unit by optically reading color variation of said absorbing member caused by absorption of the flowed ink.

12. An ink-jet printing apparatus as claimed in claim 9, which includes a label pasted over both of said ink container unit and said waste ink container unit for defining said ink guide path.

13. An ink-jet printing apparatus as claimed in claim 9, wherein said coupling member includes an engaging recessed portion, an engaging snap portion engaging with said recessed portion by elastic deformation and a spring portion biasing said engaging snap portion in a direction for fixing engagement with said recessed portion.

14. An ink-jet printing apparatus as claimed in claim 13, wherein an engaging claw engaging with respective tip ends of said engaging recessed portion and said spring portion are provided in said snap portion.

15. An ink-jet printing apparatus as claimed in claim 9, which further comprises a tank loading means for removably loading said ink tank.

16. An ink-jet printing apparatus as claimed in claim 9, wherein said ink-jet head generates a bubble in the ink by utilizing a thermal energy and ejects ink by a pressure of said bubble.

17. An ink-jet printing apparatus as claimed in claim 9, wherein said ink detecting member is disposed on a side outer surface of said ink tank on which surface said ink supply communicating portion and said ink receive communicating portion are positioned, and said communicating path has descent towards said side outer surface.

* * * * *

UNITED STATES PATENT AND TRADEMARK OFFICE

CERTIFICATE OF CORRECTION

PATENT NO. : 5,953,031

DATED : September 14, 1999

INVENTOR(S) : Kouichi Omata et al.

It is certified that error appears in the above-identified patent and that said Letters Patent is hereby corrected as shown below:

COLUMN 3:

Line 4, "the." should read --the--.

COLUMN 5:

Line 36, "arid" should read --and--.
Line 61, "filled. (8)" should read --filled.
[new paragraph] (8)--.

COLUMN 11:

Line 23, "claim 1" should read --claim 1,--.

COLUMN 12:

Line 3, "ink" should read --ink;--.

Signed and Sealed this

First Day of August, 2000

*Attest:*

Q. TODD DICKINSON

*Attesting Officer*

*Director of Patents and Trademarks*